United States Patent [19]

Masunaga et al.

[11] 4,062,791

[45] Dec. 13, 1977

[54] ELECTRICAL INSULATING OIL

[75] Inventors: Midori Masunaga, Tokyo; Yoshiki Kohno, Kawasaki; Kohji Hayashi, Yokohama, all of Japan

[73] Assignee: Nippon Oil Co., Ltd., Tokyo, Japan

[21] Appl. No.: 708,153

[22] Filed: July 23, 1976

[30] Foreign Application Priority Data

| | | |
|---|---|---|
| July 30, 1975 | Japan | 50-91949 |
| Feb. 14, 1976 | Japan | 51-14421 |

[51] Int. Cl.[2] ..... H01B 3/22

[52] U.S. Cl. ..... 252/63; 208/14; 208/19

[58] Field of Search ..... 208/14, 19; 252/63

[56] References Cited

U.S. PATENT DOCUMENTS

| | | | |
|---|---|---|---|
| 2,190,918 | 2/1940 | Goethel et al. | 208/19 |
| 3,617,473 | 11/1971 | Lipscomb | 208/14 |
| 3,627,673 | 1/1969 | Sproule et al. | 208/14 |
| 3,932,267 | 1/1976 | Lewis et al. | 208/14 |
| 3,953,319 | 4/1976 | Chesluk et al. | 208/14 |

*Primary Examiner*—Herbert Levine

*Attorney, Agent, or Firm*—Frank J. Jordan

[57] ABSTRACT

An electrical insulating oil having excellent oxidation stability, thermal stability, corona resistance, corrosion resistance and, if desired, a particularly low pour point, which consists essentially of a blend of a refined oil (I) derived from a paraffin or mixed base crude oil, a refined oil (II) prepared from a lubricating oil fraction of a mineral oil, at least one arylalkane (III) such as an alkylbenzene, and, if desired, an essentially amorphous ethylene-propylene copolymer (IV).

17 Claims, No Drawings

ELECTRICAL INSULATING OIL

This invention relates to excellent electrical insulating oils essentially derived from paraffin base crude oils or mixed base crude oils. More particularly this invention relates to an excellent electrical insulating oil consisting essentially of (A) 5 – 90% by weight of a refined oil (I) containing not more than 0.25wt.% of sulphur, the refined oil being prepared by refining with a solvent a distillate containing at least 80 wt.% of a fraction having a boiling range of 230° – 430° C at atmospheric pressure obtained by distilling a paraffin or mixed base crude oil at atmospheric pressure or distilling at a reduced pressure a bottom oil obtained by the distillation of the crude oil atmospheric pressure, thereby to obtain a raffinate which is then hydrofined, dewaxed with a solvent and, if desired, treated with a solid absorbent thus obtaining the refined oil (I), (B) 1 – 20% by weight of a refined oil (II) prepared by treating a lubricating oil fraction of a mineral oil at least with a solid adsorbent, (C) 5 – 90% by weight of at least one arylalkane (III), the three components (A), (B) and (C) being mixed together in such amounts that the mixture has a total sulphur content of not more than 0.35 wt.%, thereby to obtain the electrical insulating oil having excellent oxidation stability, thermal stability, corona resistance and corrosion resistance; this invention relates also to an excellent electrical insulating oil prepared by incorporating said electrical insulating oil having a sulphur content of not more than 0.35 wt.% as a base oil with 0.001 – 1.0 part by weight per 100 parts by weight of said base oil, of an essentially amorphous ethylene-propylene copolymer (IV) having a weight average molecular weight of 10,000 – 200,000 and a propylene content of 10 – 70 mol%, whereby is obtained the electrical insulating oil having a sufficiently low pour point in addition to the excellent properties exhibited by said insulating oil consisting essentially of the oils (I), (II) and (III).

Various insulating oils have heretofore been marketed, and the quantitatively greater part thereof has been of a mineral oil type. The reason for this is that as compared with insulating oils obtained by synthesis, mineral oil type insulating oils may be supplied at a relatively low cost and in large amounts since they are prepared from petroleum fractions as the principal starting material therefor.

On the other hand, the conventional mineral oil type insulating oils are not such that all of them may be produced from any crude oils without substantial difference in quality therebetween as is the case with gasoline or kerosene. In practice, in order to produce a mineral oil type insulating oil, it is the most important to select a crude oil for the insulating oil; more particularly, there have practically been needed, as crude oils, naphthene base crude oils which have a certain range of specific gravity, flash point and viscosity as well as a low freezing point and a low sulphur content.

There have been known many processes for the preparation of conventional mineral oil type electrical insulating oils; in these processes naphthene base crude oils have practically been used as the starting oils and, however, none of the distillates obtained by the distillation of the naphthene base crude oils are not used as electrical insulating oils without further treatment.

If the conventional known processes should apply to the preparation of electrical insulating oils from the paraffin or mixed base crude oils, there would not be prepared electrical insulating oils having satisfactory properties.

Typical processes which have heretofore been known as those for the preparation of electrical insulating oils from naphthene base crude oils, are described hereinbelow.

One known process is one for the preparation of insulating oils by effecting a treatment with sulphuric acid in a specific manner (Japanese Patent Gazette No. 10133/61); however, that process is disadvantageous in that the disposal of used sulphuric acid produced as waste therein causes environmental pollution and the yield of product obtained is low thereby rendering that process unsuitable for industrial use.

Another known process is one for the preparation of insulating oils by hydrofining a mineral oil to the extent that 65 – 96% of the sulphur content thereof has been desulphurized or by mixing the thus hydrofined mineral oil with a mineral oil containing lower aromatic compounds; however, it is seen from the following publication that products to be obtained will be greatly degraded in oxidation stability if the mineral oil is otherwise treated with a solvent prior to the hydrofining for desulphurization (Japanese Patent Gazette No. 18584/61).

Still another known process is one which comprises hydrofining a lubricating oil fraction without being treated with a solvent as in the preceding process to the extent that at least 95% of the sulphur content of said fraction and then adding a mineral oil treated with sulphuric acid to the thus hydrofined lubricating oil fraction (Japanese Laying-Open Patent Gazette No. 46199/74).

A further known process is one which comprises hydrogenating a lubricaling oil raffinate containing not more than 23 wt.% of aromatic compounds and then adding to the thus hydrogenated raffinate not more than 15 wt.% of a lubricating oil containing larger amounts of aromatic compounds (Japanese Patent Gazette No. 3589/66).

As mentioned above, each of these known processes using naphthene base crude oils as the starting materials, per se, discloses a specific process for the preparation of an electrical insulating oil. Since, however, these naphthene base crude oils have been extremely difficult to obtain since the recent petroleum panic, it has been desired to obtain electrical insulating oils from mixed or paraffin base crude oils which are available at a relatively low cost and in large amounts. Even if, on the other hand, it is attempted to obtain insulating oils from the mixed or paraffin base crude oils by the use of the same process as the usual one for the preparation of insulating oils from the naphthene base crude oils, there will not be obtained insulating oils having satisfactory oxidation stability, hydrogen gas absorbency, corona resistance, pour point and like properties. Therefore, it is necessary to employ a specific different process to obtain insulating oils having such satisfactory properties.

In addition, there has recently been disclosed a process for the preparation of insulating oils having a low pour point from paraffin base crude oils (Japanese Patent Gazette No. 46123/74); however, this known process uses a refined oil containing aromatic compounds in amounts of about 14% at most and may give the insulating oils by the addition of an antioxidant to base oils therefor.

Unlike these known processes, the process according to the present invention uses paraffin base crude oils which are available in relatively large amounts, in the preparation of the new electrical insulating oils therefrom.

On the other hand, it is a recent tendency that medium-and small-size transformers are made in more compact and light-weight form than were before. Thus, transformers of a 65° C temperature rise type (which when used will allow therein a temperature rise of 65° C higher than the conventional temperature rise by 10° C) have come to be designed, and insulating materials which are satisfactorily heat resistant to such temperature rise have therefore been sought. Conventional insulating paper and naphthene based mineral oils will not have a satisfactorily long life when used singly under such condition as above. In addition, recently, condensers and cables as well as transformers and breakers are thoroughly degased prior to being charged with an insulating oil, after which they are further treated so that they are substantially prevented from contacting air by the use of diaphrams or nitrogen enclosure; therefore, only a small amount of oxygen is present in said electrical appliances. At the present time, it is a tendency that there are sought electrical insulating oils having excellent thermal stability rather than oxidation stability.

The present inventors had made intensive studies in attempt to clarify how or under what conditions paraffin or mixed base crude oils should be treated to produce therefrom electrical insulating oils having, as their main properties, excellent oxidation stability, thermal stability, corona resistance, corrosion resistance and low-temperature properties in addition to, as a matter of course, satisfactory electrical properties, these properties being among those required in electrical insulating oils; and, as a result, they have found a novel reliable process for preparing excellent electrical insulating oils having predetermined properties.

This invention will be further detailed hereinbelow.

First of all, the refined oil (I) contained in the insulating oil of this invention as one of the essential components thereof will be explained hereunder.

The paraffin base crude oil used herein is one containing paraffinic hydrocarbons in large proportions and more particularly the crude oil is such that its first key fraction (kerosene fraction) has an API specific gravity of not smaller than 40° and its second key fraction (lubricating oil fraction boiling at 275° - 300° C at a reduced pressure of 40 mm of mercury) has an API specific gravity of not smaller than 30° as is described in "Sekiyu Binran (handbook on Petroleum)" on page 19, 1972 edition, published by Sekiyu Shunju Co., Ltd., Japan; Typical of the paraffin base crude oils are a Pennsylvania crude oil, a Minas crude oil and the like.

The mixed base crude oil used herein is one which is qualitatively intermediate between the paraffin and naphthene base crude oil and more particularly the mixed base crude oil is such that its first key fraction has an API specific gravity of 33° - 40° and its second key fraction of API specific gravity of 20° - 30°. Typical of the mixed base crude oils are Midcontinent crude oils and many of Middle East-produced crude oils such as Arabia and Khafji crude oils. In this invention there may preferably be used the Arabia crude oils such as Arabian medium and Arabian light crude oils.

The mineral oil from which the refined oil (I) is prepared is a distillate containing at least 80 wt.% of a fraction having a boiling range of 230° - 430° C, preferably 250° - 400° C, at atmospheric pressure, the fraction being obtained by distilling a paraffin or mixed base crude oil at atmospheric pressure or by distilling at a reduced pressure a bottom oil obtained by the distillation of the crude oil at atmospheric pressure. The aforementioned expression "a distillate containing at least 80 wt.% of a fraction having a boiling range of 230° - 430° C" is intended to mean that the distillate may consist of a fraction (1) having a general boiling range of 230° - 430° C, a fraction (2) having a narrower boiling range such as 240° - 390° C or 240° - 410° C within said general boiling range or a fraction (3) containing at least 80 wt.% of at least one of the fractions (1) and (2) and less than 20 wt.% of at least one of fractions respectively having boiling ranges of about 200° 230° C and 430° - about 460° C.

The starting mineral oil (derived from the paraffin or mixed base crude oil) for the refined oil (I) is treated with a solvent capable of selective dissolution of aromatic compounds to decrease the amounts of sulphur and other impurities contained in the starting oil. In this case, it is a matter of course that the aromatic compounds in the starting mineral oil also decrease in amount.

The solvents for selectively dissolving the aromatic compounds are usual ones illustrated by furfural, liquefied sulphur dioxide and phenol with furfural being particularly preferred. When furfural, for example, is used as the solvent, the extracting temperatures used may be in the range of 50° - 100° C, preferably 60° - 90° C, and the ratios by volume of furfural to the starting mineral oil may be in the range of 0.3 - 2.0, preferably 0.5 - 1.5.

Then the raffinate obtained by the refinement of the starting mineral oil with the solvent is hydrofined and thereafter dewaxed with a suitable solvent to obtain a predetermined or lower pour point on the raffinate so treated. The thus treated raffinate is consecutively treated with clay as required, thereby obtaining the refined oil (I).

The respective operational conditions under which particularly the solvent refining and hydrofining treatments of all the treatments mentioned above are effected, should be determined in combination so that the refined oil (I) to be obtained contains not more than 0.25% by weight of sulphur.

The limitation of the refined oil (I) to not more than 0.25 wt.% in sulphur content is based on a consideration that when used in transformers the resulting electrical insulating oil containing the refined oil (I) having such a low sulphur content will not aggravate "copper blackening" in the transformers which has recently raised a problem. The catalysts which may be used in the hydrofining according to this invention include the oxides of metals of Group VI, Group IB and Group VIII of the Periodic Table, the metal oxides being supported by bauxite, activated carbon, Fuller's earth, diatomaceous earth, zeolite, alumina, silica, silica alumina or the like, as the carrier. These catalysts are usually used after preliminary sulphurization thereof. Typical of the metal oxides are cobalt oxide, molybdenum oxide, tungsten oxide and nickel oxide.

In the practice of this invention there may particularly preferably be used a catalyst consisting of nickel and molybdenum oxides supported on an aluminum oxide-containing carrier, the metal oxides having been preliminarily sulphurized. The reaction temperatures in the hydrofining treatment may usually be in the range of about 230° - about 345° C, preferably 260° - 320° C. At lower reaction temperatures the reaction rate will be low, while at higher temperatures the oil to be treated with be decomposed whereby the paraffin content is increased, the pour point is somewhat raised and the resulting electrical insulating oil is not desirable in color. The reaction pressures may be at least 25 Kg/cm²G, preferably 25 - 75 Kg/cm²G and more preferably 35 - 45 Kg/cm²G. In addition, the amounts of hydrogen contacted with the oil to be hydrofined may be 100 - 10,000 Nm³/Kl of oil, preferably 200 - 1,000 Nm³/Kl of oil.

The hydrofining method employed in this invention is one in which hydrogenolysis is very highly inhibited.

As mentioned above, the refined oil (I) which is one essential component of the insulating oil of this invention, is prepared by subjecting the starting mineral oil to the refinement with the above specified solvent and the hydrofining whereby the starting oil is cause to contain sulphur in a predetermined amount which is not more than 0.25 wt.%. However, the omission of the refinement with the solvent will result in the production of electrical insulating oils having remarkably unsatisfactory thermal stability, while the omission of the hydrofining will result in the production of electrical insulating oils having remarkably unsatisfactory electrical properties, thermal stability and the like.

The solvent dewaxing according to this invention is to solidify the waxy substance in the oil for removal therefrom by the use of a known method which is usually the BK method in this case. The dewaxing solvents used herein include a mixed solvent such as benzene-toluene-acetone or benzene-toluene-methyl ethyl ketone. The suitable composition (ratio of ketonic component to aromatic components) may preferably be in the range of about 30 - 35: about 70 - 65 for such acetone-containing mixed solvents and about 45 - 50: about 55 - 50 for such methyl ethyl ketone-containing ones.

The ratios of the solvent of the oil being dewaxed may be such that the solvent-added oil fed to a dewaxing filter is kept approximately constant in viscosity. The solvent dewaxing treatment according to this invention may be carried out at any stage, particularly preferably at a stage subsequent to the hydrofining step, in the process for the preparation of the electrical insulating oils. If necessary, the thus dewaxed oil may successively be treated with a solid adsorbent. The solid adsorbent treatment stated herein is intended to mean a treatment by which a mineral oil being treated is contacted with a solid adsorbent such as acid, activated clay, Fuller's earth, alumina or silica alumina. The contact is usually effected at about 50° - 80° C for about a half hour to several hours. The contact method employed is a percolation, contact or like method.

The refined oil (II), which is a second essential component of the electrical insulating oil of this invention, is one prepared by treating at least with a solid adsorbent a lubricating oil fraction usually containing at least 80 wt.% of a fraction having a boiling range of 230°-460° C at atmospheric pressure, the latter fraction being obtained by distilling any crude oils. The aforesaid expression "a lubricating oil fraction containing at least 80 wt.% of a fraction having a boiling range of 230° - 460° C" is intended to mean that the lubricating oil fraction may consist of a fraction (1) having a general boiling range of 230° - 460° C, a fraction (2) having a narrower boiling range such as 240° - 390° C or 240° - 410° C within said general boiling range or a fraction (3) containing at least 80 wt.% of at least one of the fractions (1) and (2) and less than 20 wt.% of at least one of fractions respectively having boiling ranges of about 200° - 230° C and 460° - about 490° C. In the solid absorbent treatment effected in the preparation of the refined oil (II), there may be used the same operational conditions as used in the preparation of the refined oil (I). If the refined oil (II) is one which has been obtained without treatment with the solid adsorbent, the resulting insulating oil containing said oil (II) will be unsatisfactory in electric properties, color, thermal stability and the like.

In the preparation of the refined oil (II), there may be effected singly or jointly a solvent refining (refining with a solvent) treatment, a dewaxing treatment, a sulphuric acid refining (refining with sulphuric acid) treatment and the like, prior to the solid adsorbent treatment.

The operational conditions for these solvent refining and solvent dewaxing treatments are the same with those employed in the preparation of the refined oil (I); and the operational conditions for the sulphuric acid refining treatment are identical with conventional ones used in the sulphuric acid refining treatment of ordinarly mineral oils. Since, however, the sulphuric acid refining treatment raises a problem of the disposal of used or waste sulphuric acid, the other refining treatments are preferably used. The refined oil (II) should be reduced to preferably about 0.1 - 2 wt.% and more preferably about 0.2 - 1 wt.% in sulphur content.

As previously mentioned, if the solid absorbent treatment is to be effected in the preparation of the refined oil (I) as in the case of the refined oil (II), the dewaxed hydrofined raffinate for the oil (I) and the lubricating oil fraction for the oil (II) may simultaneously be subjected to said treatment after these materials have been mixed together.

The use of less than 1 part by weight of the refined oil (II) as one of the essential components will result in the production of an electrical insulating oil which is satisfactory in corrosion resistance, corona resistance and thermal stability but unsatisfactory in oxidation stability, while the use of more than 20 parts by weight of the refined oil (II) will result in producing an electrical insulating oil which is inferior in corrosion resistance and thermal stability.

The arylalkanes (III) which are a third essential component of the electrical insulating oil of this invention, are alkylbenzenes represented by the following general formula

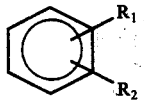

wherein $R_1$ and $R_2$ are each hydrogen or a hydrocarbon residue having 1 to 20 carbon atoms with a proviso that $R_1$ and $R_2$ have at least 9 carbon atoms, preferably 12 - carbon atoms in total. If the total number of carbon atoms in $R_1$ and $R_2$ of the formula is less than 9, arylalkanes of this formula will exhibit unsatisfactory flash point distillation properties and the like and are therefore unsuitable for use in the insulating oil of this invention. The hydrocarbon residues expressed by the symbols $R_1$ and $R_2$ may be of straight chain or branched chain structure. In addition, said alkylbenzenes may contain tetralin, indene, indane or their hydrocarbon derivatives in amounts of no more than about 50 % by weight.

These alkylbenzenes may usually be obtained by condensing (alkylating) benzene with at least one olefin or halogenated paraffin in the presence of an acid catalyst such as a Friedel-Crafts type catalyst. For industrial uses there may preferably be used monoalkylbenzenes having about 9 - 16 carbon atoms, heavy alkylbenzenes as by-products and a bottom oil separated, by distillation, from alkylbenzenes for use as raw material for a cleanser, these three kinds of materials being obtained at the time of synthesis of straight chain or branched chain alkylbenzenes for use as raw material for cleansers. The thus obtained arylalkanes (III) may preferably be used in the preparation of the insulating oils of this invention after they have been treated with the aforesaid specified solid adsorbent; in this case, they (III) may alternatively be treated with the solid adsorbent after they have been mixed with any one or both of the hydrofined dewaxed oil for the refined oil (I) and the lubricating oil fraction for the refined oil (II). It is generally preferable that the arylalkanes are hydrofined prior to its from the viewpoint of improvement in electrical properties and the like. The catalysts which may be used for this hydrofining are at least one member selected from the metals of Groups VI, VII and VIII as well as the oxides and sulphides thereof, the at least one member being preferably supported by silica, alumina, diatomaceous earth, activated carbon or the like as a carrier. Typical of the catalysts are palladium, platinum, nickel, copper-chromium, cobalt-molybdenum, nickelmolybdenum, nickel-tungsten and the like. The hydrofining may be carried out at a pressure of usually 2 - 50 $Kg/cm^2G$, a temperature of 50° - 400° L C and a LHSV (liquid hourly space velocity) of 1 - 15 vol./vol.

If straight chain type heavy alkylbenzenes having a boiling range of not lower than about 300° C are used as the arylalkanes according to this invention, it will be particularly preferable to hydrofine said heavy alkylbenzenes under such conditions as to selectively hydrofine only the alkylated polycyclic aromatic compounds contained as impurities in the heavy alkylbenzenes thereby to obtain hydrofined alkylbenzenes having an absorbancy of not higher than $0.4 \times 10^{-3}$ g/1·cm at visible rays having a wavelength of 400 mμ.

The electrical insulating oils of this invention consist essentially of 5 - 90 wt.%, preferably 30 - 80 wt.%, of the first component (I), 1 - 20 wt.%, preferably 2 - 10 wt.%, of the second component (II) and 5 - 90 wt.% of the third component (III), the three components being mixed together in such amounts that the mixture has a sulphur content of not higher than 0.35 wt.%.

Further, it has also been found by the present inventors that the use of the at least one arylalkane which is the third component will result in the production of an electrical insulating oil of this invention which is more excellent in thermal stability than conventional naphthene-based ones and is as excellent in corona resistance and low-temperature properties as the latter. If the amount of the third component (at least one arylalkane) (III) mixed is less than 5 wt.% then the resulting electrical insulating oil will be not fully satisfactory in thermal stability, corona resistance and the like, while if the amount thereof used is more than 90 wt.% then resulting insulating oil will not further be improved in said properties despite of the fact that the insulating oil is obtained uneconomically at a higher cost. Usually, the third component is mixed in amounts of preferably 10 - 50 wt.%. (Particularly when insulating oil having a lower pour point is desired then the third component is mixed in amounts of 50 - 90 wt.%.) As is seen from the above, it has further been found by the present inventors that if the first component is mixed with any one of the second and third components then the resulting insulating oil will neither be improved nor fully satisfactory in oxidation stability, while the first component is mixed with both of the second and third components than the resulting insulating oil will be very excellent in oxidation stability. As stated before, it is required that the mixture of the components (I) to (III) according to this invention be limited to not higher than 0.35 wt.% in sulphur content since if the sulphur content exceeds 0.35 wt.% then the resulting mixture will be degraded in corrosion resistance (copper blackening resistance) and rendered unsuitable for effective use as an electrical insulating oil. The sulphur content should preferably be limited to as low as about 0.05 to about 0.3 wt.% according to this invention.

In another embodiment of this invention, the aforementioned electrical insulating oil as the base oil, which was obtained mainly from the paraffin or mixed base crude oil by the use of the aforesaid specified process, may be incorporated with an essentially amorphous ethylene-propylene copolymer (IV) as the fourth component thereby to obtain desired electrical insulating oil compositions which are further improved in low-temperature properties.

The electrical insulating oil, as the base oil, of this invention has a depressed pour point by having been dewaxed with a solvent for dewaxing, as mentioned above. It is possible to depress the pour point of an electrical insulating oil to about −27.5° C at best by the use of a conventional dewaxing apparatus; JIS(Japan Industrial Standard) C-2320 provides that the pour point shall not be higher than −27.5° C. In view of the use of the conventional dewaxing apparatus, it is economically desirable that the resulting dewaxed insulating oil has a pour point of about −25° C at lowest. This invention eliminates the aforesaid disadvantages and makes it possible to depress the pour points of electrical insulating oils easily and more economically without effecting a solvent dewaxing treatment under strict conditions. In other words, the invention makes it possible to produce easily and more economically an end product having a pour point of not higher than −27.5° C or even an end product having a very low pour point of as low as −40° C or lower which cannot be attained by the conventional solvent dewaxing process.

The pour point depressants which have heretofore been extensively used in the preparation of lubricating oils, are mostly polymethacrylates. However, these depressants when used in the lubricating oil will, as an advantageous effect, depress it in pour point and will, as disadvantageous side effects, degrade it in water separability, emulsification resistance and electrical properties. They, particularly when used in an electrical insulating oil, will remarkably degrade it in emulsification resistance, this rendering them unsuitable as a pour point depressant for the oil.

This invention is further characterized by the fact that the incorporation of the essentially amorphous ethylenepropylene copolymer in the specified base oil will depress the resulting electrical insulating oil in pour point without impairing its electrical properties, oxidation stability, emulsification resistance and other indispensable properties.

In the practice of this invention, it is desirable that the base oil for the final electrical insulating oil be lowered to not higher than −15° C in pour point by an ordinary solvent dewaxing treatment in view of the cost of the solvent dewaxing treatment and the effect of the ethylene-propylene copolymer added. The use of the base oil having too high a pour point is undesirable since such a base oil will require a more amount of the ethylene-propylene copolymer added, thereby increasing the resulting insulating oil in viscosity and consequently lowering it in cooling effect which is an important characteristic of an electrical insulating oil.

The essentially amorphous ethylene-propylene copolymers according to this invention may be added to the mixed or base oil containing the three components (I) to (III), in amounts of 0.001 - 1.0, preferably 0.01 - 0.2 parts by weight per 100 parts by weight of the base oil.

The amorphous ethylene-propylene copolymer is an oil-soluble one having a weight average molecular weight of 10,000 - 200,000, preferably 20,000 - 70,000 and a propylene content of 10 - 70 mol%, preferably 20 - 60 mol%. The term "amorphous copolymer" used herein is intended to mean an amorphous copolymer which has some degree of crystallization, usually 0 - 5 % and preferably 0 - 2 % of crystallization. Furthermore, the amorphous copolymer should preferably be one having such a relatively narrow distribution of molecular weight as usually not more than 8, particularly preferably not more than 4.

The ethylene-propylene copolymers according to this invention may be prepared by specific known processes. The polymerization for the preparation of the copolymers may be effected by introducing ethylene, propylene and hydrogen gas into a catalyst composition comprising an organic solvent soluble homogeneous Ziegler-Natta type catalyst and an inert organic solvent for dispersing the catalyst therein, at an atmospheric to somewhat elevated pressure (usually, about 1 to 20 $Kg/cm^2$) and at a low to somewhat elevated temperature (usually, about −50° to 50° C). Ethylene and propylene are different in polymerizing reaction rate from each other, and the reaction rate of ethylene is much higher than that of propylene; because of this, the monomeric ratio between ethylene and propylene used does not agree with that between the two contained in the resulting copolymer. It is therefore necessary to pay a careful attention to the monomeric ratio of ethylene to propylene used in order to obtain an ethylenepropylene copolymer having a desired propylene content.

The homogenizable Ziegler-Natta type catalysts which may preferably be used in the preparation of the specific copolymer according to this invention, include coordination catalysts consisting of both a Vanadium compound represented by the general formula $VO(OR)_nX_{3-n}$ wherein X is chlorine, bromine or iodine, R is a residue of hydrocarbons having 1 - 6 carbon atoms and n is an integer of 0 - 3, and an organoaluminum halide represented by the general formula $R_1A1X_2$, $R_1R_2A1X$ or $R_1R_2R_3A1_2X_3$ wherein $R_1$, $R_2$ and $R_3$ are a residue of hydrocarbons having 1 - 20 carbon atoms and may be different from, or identical with, each other. Typical of the organoaluminum halides are diethyl aluminum chloride, diisopropyl aluminum chloride and ethyl aluminum dichloride. The inert organic solvents usually used in the copolymerization include aliphatic and aromatic hydrocarbons with n-hexane, heptane, toluene, xylene and the like being preferred.

This invention will be better understood by the following non-limitative examples for illustration purpose only, in which examples all parts and percentages are by weight unless otherwise specified.

EXAMPLE 1

There was obtained a distillate (boiling range of 240° – 390° C at atmospheric pressure, sulphur content of 2.0 wt.% and aromatic content of 41 wt.%) by distilling a Middle East-produced (mixed base) crude oil at atmospheric pressure to recover a bottom oil and then distilling the thus recovered bottom oil at a reduced pressure. The distillate so obtained was extracted with furfural in the ratio by volume of 1.3 between the furfural and distillate at a temperature of 75° - 95° C to obtain a raffinate which is then hydrofined in the presence of an $NiO - MoO_3$ catalyst (NiO: 3.0 wt.%; $MoO_3$: 14.0 wt.%) carried on alumina, at a temperature of 320° C and a hydrogen pressure of 40 $Kg/cm^2G$ and at a liquid hourly space velocity (LHSV) of 1.0. The reffinate so hydrofined was dewaxed with a benzene-toluene-methyl ethyl ketone mixed solvent in the solvent ratio of 1.6 between the solvent and the hydrofined raffinate and at a cooling temperature of −30° C and was then treated with clay at 70° C for one hour, thereby obtaining a refined oil (I) having a pour point of −27.5° C, sulphur content of 0.09 wt.%. The refined oil (I) so obtained was measured for its acid value by the use of an oxidation stability test prescribed in JIS (Japanese Industrial Standard) C 2101 with the result that its acid value was found to be 1.95 mg KOH/g.

The aforementioned distillate obtained by the distillation at the reduced pressure was likewise extracted with furfural in the solvent ratio of 1.6 between the solvent and the distillate, thereby producing a raffinate which was subjected to the same solvent dewaxing treatment as in the preparation of the refined oil (I) and then subjected to clay treatment at 70° C for an hour whereby a refined oil (II) of this invention having a sulphur content of 0.95 wt.%. There was blended together 65 parts by weight of the thus obtained refined oil (I), 5 parts by weight of the thus obtained refined oil (II) and 30 parts of refined alkylbenzenes (III) prepared by treating starting heavy alkylbenzenes having a boiling range of about 310° - 404° C with clay at 70° C for one hour, the starting heavy alkylbenzenes being obtained as by-products at the time of synthesis of alkylbenzenes (in which the alkyl was of branched chain type) for use as raw material for cleansers by reacting benzene with olefins mainly containing propylene tetramer in the presence of a boron trifluoride catalyst, thereby to obtain an electrical insulating oil of this invention having an acid value of 0.19 mgKOH/g as determined by the JIS oxidation stability test.

Three hundred milliliters of the electrical insulating oil so obtained were introduced into a 500-ml glass vessel in which copper electrodes were provided 2 mm apart from each other, and a current application test was conducted at an application of 10 KV to the electrodes and at 100° C in a nitrogen atmosphere for 10 days with the result that the amount of sulphur deposited on the electrodes was found to be only 3.2 μg. Furthermore, the electrical insulating oil obtained in this Example was tested for its hydrogen gas absorbency which is an indicator of corona resistance, by the method (based on the "Technical report No. 6, the Research Committee of Electrical Insulating Oils of Japan") with a satisfactory result that [(a value obtained after 150 minutes) — (a value obtained after 50 minutes)] was −45 mm Oil.

This insulating oil after subjected to a heating test (ASTM D 1934), had a satisfactory dielectric loss tangent of 0.30% (at 80° C) and volume resistivity of 3.9 × $10^{13}$ ω - cm (at 80° C).

EXAMPLES 2 - 3 AND COMPARATIVE EXAMPLES 1 - 2

The refined oil (I), the refined oil (II) and the refined arylalkanes (III) as mentioned in Example 1 were mixed together in various proportions as indicated in the following Table 1 and the properties of the electrical insulating oils so obtained are also indicated in the same Table.

The electrical insulating oil prepared by mixing together only the refined oil (I) and the arylalkanes (III) in Comparative example 1 is hardly improved in oxidation stability. The insulating oil prepared by mixing only the refined oils (I) and (II) in Comparative example 2 is considerably improved in oxidation stability but is not fully satisfactory in oxidation stability, hydrogen gas absorbency and thermal stability.

In contrast, the insulating oils prepared by mixing together the refined oil (I), the refined oil (II) and the arylalkanes (III) in Examples 2 and 3 are remarkably improved not only in oxidation stability but also in hydrogen gas absorbency and thermal stability.

Table 1

| Examples and Comparative examples | Composition of Insulating Oil (Parts) | | | Properties of insulating oils | | | | | |
|---|---|---|---|---|---|---|---|---|---|
| | | | | | Oxidation stability (JISC2101) | | Hydrogen gas absorbency (Value for 150 min.)-(Value for 50 min.) mm Oil | Thermal stability (ASTMD1934, No catalyst) | |
| | Refined oil (I) | Refined oil (II) | Arylalkanes (III) | Sulphur (wt.%) | acid value mgKOH/g | Sludge % | | Dielectric loss tangent (80° C,%) | Volume resistivity (×$10^{12}$) 80° C,Ω . cm |
| Comparative Example 1 | 70 | — | 30 | 0.06 | 1.90 | 0.41 | — | — | — |
| Example 2 | 95 | 5 | — | 0.13 | 0.43 | 0.16 | −29 | 0.85 | 6.5 |
| Example 2 | 75 | 5 | 20 | 0.10 | 0.18 | 0.08 | −40 | 0.33 | 31.0 |
| Example 3 | 55 | 5 | 40 | 0.08 | 0.14 | 0.07 | −52 | 0.18 | 45.0 |

EXAMPLE 4

There was obtained a distillate (boiling range of 240° - 400° C at atmospheric pressure, sulphur content of 2.2 wt.% and aromatic content of 42 wt.%) by distilling a Middle East-produced (mixed base) crude oil at atmospheric pressure to recover a bottom oil and then distilling the thus recovered bottom oil at a reduced pressure. The distillate so obtained was extracted with furfural in the ratio by volume of 1.5 between furfural and distillate at a temperature of 75° - 95° C to obtain a raffinate which is then hydrofined in the presence of an NiO-$WO_3$ catalyst (NiO: 6.2 wt.%; $WO_3$: 19.2 wt.%) carried on alumina, at a temperature of 310° C and a hydrogen pressure of 35 Kg/cm²G and at a liquid hourly space velocity (LHSV) of 1.0. The reffinate so hydrofined was dewaxed with a benzene-toluene-methyl ethyl ketone mixed solvent in the solvent ratio of 1.6 between the solvent and the hydrofined raffinate and at a cooling temperature of −30° C and was then percolated with alumina gel at 60° C for 1 hour, thereby obtaining a refined oil (I) having a pour point of −27.5° C and sulphur content of 0.13 wt.%. The refined oil (I) so obtained was measured for its acid value by the use of an oxidation stability test prescribed in JIS (Japanese Industrial Standard), C 2101 with the result that its acid value was found to be 0.58 mgKOH/g.

Separately, a distillate boiling range of 255° - 405° C) obtained by the distillation of Niitsu (Japan) type crude oil at a reduced pressure was likewise extracted with furfural in the solvent ratio of 1.3 between the solvent and the distillate, thereby producing a raffinate which was subjected to the clay treatment at 70° C for 1 hour as in the preparation of the refined oil (I) whereby a refined oil (II) of this invention having a sulphur content of 0.32 wt.%. There were blended together 95 parts by weight of the thus obtained refined oil (I) and 5 parts by weight of the thus obtained refined oil (II) to obtain an electrical insulating oil of this invention having an acid value of 0.45 mgKOH/g as determined by the JIS oxidation stability test. In addition, the reaction of benzene with olefins mainly containing propylene tetramer was effected in the presence of a boron trifluoride catalyst thereby to obtain alkylbenzenes (in which the alkyl is of branched chain type) having a boiling range of 248° - 360° C at atmospheric pressure as arylalkanes (III). Seventy parts by weight of the refined oil (I) and 30 parts by weight of the arylalkanes (III) were blended together to obtain a comparative insulating oil having an acid value of 0.52 mgKOH/g as determined by the oxidation stability test.

Sixty-five parts by weight of the refined oil (I), 5 parts by weight of the refined oil (II) and 30 parts by weight of the arylalkanes (III) were blended together thereby to obtain a desired insulating oil (sulphur content: 0.09 wt.) of this invention. The desired insulating oil had an acid value of 0.15 mgKOH/g which was remarkably more satisfactory than that of the comparative insulating oil. The desired insulating oil was subjected to the same current application test as used in Example 1 with the result that the amount of sulphur deposited on copper electrodes is only 2.8 μg. The desired oil was also satisfactory in hydrogen gas absorbency which was expressed by "-56 mm Oil ([value obtained after 150 minutes] - [value obtained after 50 minutes]). The desired oil further had satisfactory dielectric loss tangent of 0.18% at 80° C and volume resistivity of 6.5 × $10^{13}$ ω.cm at 80° C after having been subjected to the heat test according to ASTM D1934.

EXAMPLE 5

There was obtained a distillate (boiling range of 240° - 410° C) at atmospheric pressure and sulphur content of 2.0 wt.% by distilling a Middle East-produced (mixed base) crude oil at atmospheric pressure to recover a bottom oil and then distilling the thus recovered bottom oil at a reduced pressure. The distillate so obtained was extracted with furfural in the ratio by volume of 1.3 between furfural and distillate at a temperature of 75° - 95° C to obtain a raffinate which was then hydrofined in the presence of a $NiO-MoO_3$ catalyst (NiO: 3.0 wt.%; $MoO_3$: 14.0 wt.%) carried on alumina, at a temperature of 325° C and a hydrogen pressure of 40 $Kg/cm^2G$ and at a liquid hourly space velocity (LHSV) of 1.0. The raffinate so hydrofined was dewaxed with a benzene-toluene-methyl ethyl ketone mixed solvent in the solvent ratio of 1.6 between the solvent and the hydrofined raffinate and at a cooling temperature of −25° C and was then treated with clay at 70° C for one hour, thereby obtaining a refined oil (I) having a pour point of −22.5° C and sulphur content of 0.09 wt.%.

The same distillate as used in the preparation of the refined oil (I) was extracted at 75° - 95° C with furfural in the solvent ratio of 1.6 between the solvent and the distillate, thereby producing a raffinate which was subjected to the same solvent dewaxing and clay treatments as used in the preparation of the refined oil (I) whereby was obtained a refined oil (II) according to this invention having a pour point of −22.5° C and a sulphur content of 0.90 wt.%. There were blended together 65 parts by weight of the refined oil (I), 5 parts by weight of the refined oil (II) and 30 parts by weight of refined alkylbenzenes prepared by treating starting heavy alkylbenzenes having a boiling range of about 310° - 404° C with clay at 70° C for 1 hour, the starting alkylbenzenes being obtained as by-products at the time of synthesis of alkylbenzenes (wherein the alkyl was of branched chain type) by reacting benzene with olefins mainly containing propylene tetramer in the presence of a boron trifluoride catalyst, thereby to obtain an electrical insulating oil (A) as a base oil. The base oil (A) was then incorporated with 0.1 wt.% of an amorphous ethylenepropylene copolymer having a weight average molecular weight of 40,000 and a propylene content of 37.5 mol%, to obtain an electrical insulating oil (B). The insulating oil (B) so obtained was an excellent one having a low pour point and, furthermore, it was as excellent in other properties as the insulating oil (A).

COMPARATIVE EXAMPLE 3

The electrical insulating oil (A) as obtained in Example 5 was incorporated with 0.2 wt.% of a polymethacrylate which was a commercially available pour point depressant thereby to obtain an electrical insulating oil (C) the properties of which are shown in Table 2. As is clear from Table 2, the insulating oil (C) as compared with the base oil (A) has a low pour point but has remarkably unsatisfactory electrical properties, emulsification resistance, thermal stability and the like. Thus the oil (C) is not useful in certain cases.

Table 2

| | Insulating oil (A) (obtained in Example 5) | Insulating oil (B) (obtained in Example 5) | Insulating oil (C) (Comparative example 3) |
|---|---|---|---|
| Pour point (° C) | −25 | −47.5 | −45 |
| JIS Oxidation stability*1 | | | |
| Sludge (%) | 0.06 | 0.06 | 0.09 |
| Acid value (mgKOH/g) | 0.18 | 0.19 | 0.25 |
| Steam emulsion number*2 (sec) | 41 | 38 | at least 1200 |
| Volume resistivity (80° C,Ω . cm) | $5.6 \times 10^{15}$ | $5.1 \times 10^{15}$ | $0.79 \times 10^{15}$ |
| Dielectric loss tangent (80° C,%) | 0.004 | 0.005 | 0.021 |
| Thermal stability*3 | | | |
| Volume resistivity (80° C,Ω . cm) | $5.8 \times 10^{13}$ | $6.3 \times 10^{13}$ | $0.65 \times 10^{13}$ |
| Dielectric loss tangent (80° C,%) | 0.21 | 0.19 | 0.83 |

*1JIS C2101
*2JIS K2517
*3ASTM D1934 No catalyst

What is claimed is:

1. An electrical insulating oil consisting essentially of (A) 5 - 90% by weight of a refined oil (I) containing not more than 0.25 wt.% of sulphur, the refined oil (I) being prepared by the steps of:

refining with a solvent capable of selectively dissolving aromatic compounds a distillate containing at least 80 wt.% of a fraction having a boiling range of 230° - 430° C at atmospheric pressure obtained by the distillation of a paraffin or mixed base crude oil at atmospheric pressure or the distillation at a reduced pressure of a bottom oil obtained by the distillation of the crude oil at atmospheric pressure thereby to obtain a raffinate from said distillate, hydrofining the raffinate so obtained, and dewaxing the thus hydrofined raffinate with a solvent, (B) 1 - 20% by weight of a refined oil (II) prepared by treating at least with a solid absorbent a lubricating oil fraction containing at least 80 wt.% of a mineral oil having a boiling range of 230° - 460° C at atmospheric pressure obtained from a crude oil and (C) 5 - 90% by weight of at least one arylalkane (III), the three components (I) - (III) being mixed together in such amounts that the mixture has a total sulphur content of not more than 0.35 wt.%, thereby to obtain the electrical insulating oil having excellent oxidation stability, thermal stability, corona resistance and corrosion resistance.

2. An electrical insulating oil consisting essentially of (A) 5 - 90% by weight of a refined oil (I) containing not more than 0.25 wt.% of sulphur, the refined oil (I) being prepared by the steps of:

refining with a solvent capable of selectively dissolving aromatic compounds a distillate containing at least 80 wt.% of a fraction having a boiling range of 230° - 430° C at atmospheric pressure obtained by the distillation of a paraffin of mixed base crude oil at atmospheric pressure or the distillation at a reduced pressure of a bottom oil obtained by the distillation of the crude oil at atmospheric pressure thereby to obtain a raffinate from said distillate, hydrofining the raffinate so obtained, and dewaxing the thus hydrofined raffinate with a solvent, (B) 1 - 20% by weight of a refined oil (II) prepared by treating at least with a solid absorbent a lubricating oil fraction containing at least 80 wt.% of a mineral oil having a boiling range of 230° - 460° C at atmospheric pressure obtained from a crude oil, (C) 5 - 90% by weight of at least one arylalkane (III), the three components (I) - (III) being mixed together in such amounts that the mixture has a total sulphur content of not more than 0.35 wt.%, to obtain an electrical insulating oil as a base oil, and (D) 0.001 – 1.0 part by weight per 100 parts by weight of said base oil, of an essentially amorphous ethylene-propylene copolymer (IV) having an average molecular weight of 10,000 – 200,000 and a propylene content of 10 – 70 mol%, thereby to obtain the electrical insulating oil having excellent oxidation stability, thermal stability, corona resistance, corrosion resistance and low-temperature properties.

3. An electrical insulating oil according to claim 1, wherein the arylalkane (III) is an alkylbenzene represented by the general formula

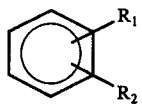

wherein $R_1$ and $R_2$ are a hydrocarbon residue having 1 – 20 carbon atoms with a proviso that they have at least 9 carbon atoms in total.

4. An electrical insulating oil according to claim 2, wherein the arylalkane (III) is an alkylbenzene represented by the general formula

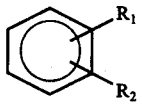

wherein $R_1$ and $R_2$ are a hydrocarbon residue having 1 – 20 carbon atoms with a proviso that they have at least 9 carbon atoms in total.

5. An electrical insulating oil according to claim 1, wherein the arylalkane (III) is a mixture of an alkylbenzene according to claim 3 with not more than 50 wt.%, based on the arylalkane, of a member selected from the group consisting of tetralin, indene, indane and their hydrocarbon derivatives.

6. An electrical insulating oil according to claim 2, wherein the arylalkane (III) is a mixture of an alkylbenzene according to claim 4 with not more than 50 wt.%, based on the arylalkane, of a member selected from the group consisting of a member selected from the group consisting of tetralin, indene, indane and their hydrocarbon derivatives.

7. An electrical insulating oil according to claim 1, wherein the dewaxed hydrofined raffinate is further treated with a solid adsorbent.

8. An electrical insulating oil according to claim 2, wherein the dewaxed hydrofined raffinate is further treated with a solid adsorbent.

9. An electrical insulating oil according to claim 1, wherein the solvent capable of selectively dissolving aromatic compounds is a member selected from the group consisting of furfural, liquefied sulphur dioxide and phenol.

10. An electrical insulating oil according to claim 1, wherein the hydrofining is effected at a temperature of about 230° – about 345° C and pressures of at least 25 $Kg/cm^2G$ in the presence of a catalyst selected from the group consisting of the oxides of metals of Groups VI, IB and VIII, the catalyst being usually sulphurized prior to its use and supported on a carrier selected from the group consisting of bauxite, activated carbon, Fuller's earth, diatomaceous earth, zeolite, alumina, silica and silica alumina.

11. An electrical insulating oil according to claim 1, wherein the solvent for dewaxing is a member selected from the group consisting of a benzene-toluene-acetone mixed solvent and a benzene-toluene-methyl ethyl ketone mixed solvent.

12. An electrical insulating oil according to claim 1, wherein the solid adsorbent is a member selected from the group consisting of acid clay, activated clay, Fuller's earth, alumina and silica alumina.

13. An electrical insulating oil according to claim 2, wherein the solvent capable of selectively dissolving aromatic compounds is a member selected from the group consisting of furfural, liquefied sulphur dioxide and phenol.

14. An electrical insulating oil according to claim 2, wherein the hydrofining is effected at temperatures of about 230° – about 345° C and pressures of at least 25 $Kg/cm^2G$ in the presence of a catalyst selected from the group consisting of the oxides of metals of Groups (VI), (IB) and (VIII), the catalyst being usually sulphurized prior to its use and supported on a carrier selected from the group consisting of bauxite, activated carbon, Fuller's earth, diatomaceous earth, zeolite, alumina, silica and silica alumina.

15. An electrical insulating oil according to claim 2, wherein the solvent for dewaxing is a member selected from the group consisting of a benzene-toluene-acetone mixed solvent and a benzene-toluene-methyl ethyl ketone mixed solvent.

16. An electrical insulating oil according to claim 2, wherein the solid adsorbent is a member selected from the group consisting of acid clay, activated clay, Fuller's earth, alumina and silica alumina.

17. An electrical insulating oil according to claim 2, wherein the amorphous ethylene-propylene copolymer is one prepared by introducing ethylene, propylene and hydrogen gases through a homogenizable Ziegler-Natta type catalyst at temperatures usually from about −50° to about 50° C and pressures usually from about 1 to about 20 $Kg/cm^2$ Absolute.

* * * * *